US009118137B2

(12) United States Patent
Suzuki et al.

(10) Patent No.: US 9,118,137 B2
(45) Date of Patent: Aug. 25, 2015

(54) CONNECTOR CAPABLE OF RESTRICTING A RELATIVE ROTATIONAL MOVEMENT BETWEEN FEMALE AND MALE CONNECTORS

(71) Applicant: YAZAKI CORPORATION, Minato-ku, Tokyo (JP)

(72) Inventors: Miki Suzuki, Makinohara (JP); Takashi Matsunaga, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 79 days.

(21) Appl. No.: 13/917,677

(22) Filed: Jun. 14, 2013

(65) Prior Publication Data

US 2013/0280949 A1 Oct. 24, 2013

Related U.S. Application Data

(63) Continuation of application No. PCT/JP2011/006872, filed on Dec. 8, 2011.

(30) Foreign Application Priority Data

Dec. 24, 2010 (JP) ..... 2010-287385

(51) Int. Cl.
*H01R 13/64* (2006.01)
*H01R 13/42* (2006.01)
*H01R 13/631* (2006.01)

(52) U.S. Cl.
CPC ..... *H01R 13/42* (2013.01); *H01R 13/631* (2013.01)

(58) Field of Classification Search
CPC .... H01R 13/631; H01R 13/629; H01R 13/64; H01R 13/6456
USPC ..... 439/374, 680, 357
See application file for complete search history.

(56) References Cited

U.S. PATENT DOCUMENTS 6,843,677 B2 * 1/2005 Fukuda ..... 439/374
6,910,916 B2 * 6/2005 Murakami ..... 439/532

(Continued)

FOREIGN PATENT DOCUMENTS

CN 1036669 A 10/1989
CN 1716708 A 1/2006

(Continued)

OTHER PUBLICATIONS

Japanese official action issued on Sep. 9, 2014 in the counterpart Japan patent application. (Partial English translation also submitted. ).

(Continued)

*Primary Examiner* — Hae Moon Hyeon
(74) *Attorney, Agent, or Firm* — Marvin A. Motsenbocker; Mots Law, PLLC

(57) ABSTRACT

A connector includes a female connector and a male connector fitted in a hood of the female connector. The female connector includes: paired guide grooves either provided at opposed positions on an inside wall of the hood; and regulation projections either provided on bottom surfaces of the paired guide grooves. The male connector includes paired guide ribs provided on an outer periphery of the male connector. The paired guide ribs either positioned in the paired guide grooves with the female connector and the male connector being fitted together regulate a relative rotational movement between the female and male connector. The regulation projections either in contact with the paired guide ribs regulate a relative vertical and transverse movement between the female and male connectors.

6 Claims, 9 Drawing Sheets

(56) References Cited

U.S. PATENT DOCUMENTS

| | | | | |
|---|---|---|---|---|
| 7,104,840 | B2 * | 9/2006 | Murakami | 439/587 |
| 7,481,674 | B2 * | 1/2009 | Murakami et al. | 439/587 |
| 7,503,791 | B2 * | 3/2009 | Fukaya et al. | 439/275 |
| 7,572,135 | B2 * | 8/2009 | Kozono et al. | 439/248 |
| 2004/0072465 | A1 | 4/2004 | Murakami | |

FOREIGN PATENT DOCUMENTS

| | | | |
|---|---|---|---|
| JP | 2002-198127 | A | 7/2002 |
| JP | 2004-296452 | A | 10/2004 |
| JP | 2007-059153 | A | 3/2007 |
| JP | 2007-103117 | A | 4/2007 |
| JP | 2009-164145 | A | 7/2009 |

OTHER PUBLICATIONS

Korean office action issued on May 27, 2014 in the counterpart Korean patent application. (Partial English translation also submitted.).

Chinese official action letter issued on Feb. 11, 2015 in the counterpart Chinese patent application.

German office action letter issued on Jun. 10, 2015 in the counterpart German patent application.

* cited by examiner

Prior Art

CONNECTOR CAPABLE OF RESTRICTING A RELATIVE ROTATIONAL MOVEMENT BETWEEN FEMALE AND MALE CONNECTORS

CROSS REFERENCE TO RELATED APPLICATION

This application is a Continuation of PCT Application No. PCT/JP2011/006872, filed on Dec. 8, 2011, and claims the priority of Japanese Patent Application No. 2010-287385, filed on Dec. 24, 2010, the content of both of which is incorporated herein by reference.

BACKGROUND

1. Technical Field

The present invention relates to a connector for connection of terminals of electric wire terminals.

2. Related Art

Patent Literature 1 describes a connector for electrical connection of female terminals and male terminals of electric wire terminals.

This kind of connectors have connector housings which accommodate a female connector and a male connector therein and are fitted together for a connection of female terminals and male terminals.

FIGS. 1A to 1C are views illustrating the connector described in Patent Literature 1. As illustrated in FIGS. 1A to 1C, a connector 100 includes a female connector 102 which accommodates female terminals therein and a male connector 104 which accommodates male terminals therein.

As illustrated in FIGS. 1A and 1B, the female connector 102 includes a cylindrically formed female connector housing 121, a connector main body 123 which is provided with a terminal receiver 122 accommodating the female terminals therein, guide grooves 124 into which guide ribs 144 to be described below are insertable, and regulation projections 125 which are provided inside the female connector housing 121.

As illustrated in FIGS. 1A and 1C, the male connector 104 includes a cylindrically formed male connector housing 141, male terminal receivers 142 which accommodate the male terminals therein, a fitting hood 143 to be inserted inside the female connector 102, and the guide ribs 144 which extend and project from the front to back along the entire length of the fitting hood 143, and are insertable into the guide grooves 124.

The guide ribs 144 are inserted into the guide grooves 124 to fit the female connector 102 with the male connector 104. At this time, the regulation projections 125 provided in diagonal positions of the inside of the female connector housing 121 are in contact with the fitting hood 143, holding a fitting state where the female connector 102 and the male connector 104 are fitted together.

CITATION LIST

Patent Literature

[PTL 1] Japanese Unexamined Patent Application Publication No. 2002-198127

SUMMARY

However, in the related connector 100 described above, the female connector housing 121 is elastically expanded and the regulation projections 125 are brought into contact with the fitting hood 143, thereby restricting a relative rotational movement between the female connector 102 and the male connector 104.

This causes a problem of an increase in a fitting force in portions where the regulation projections 125 are not in contact with the fitting hood 143 without a proper amount of clearance (clearance gap) between the fitting hood 143 and the regulation projections 125.

An object of the present invention is to provide a connector capable of restricting a relative rotational movement between a female connector and a male connector and inhibiting an increase in a fitting force with which the female connector and the male connector are fitted together.

A connector in accordance with some embodiments includes a female connector configured to accommodate a female terminal of an electric wire terminal and have a hood and a male connector configured to accommodate a male terminal of an electric wire terminal and be fitted in the hood for connection of the female terminal and the male terminal. The female connector includes paired guide grooves either provided at opposed positions on an inside wall of the hood, and regulation projections either provided on bottom surfaces of the paired guide grooves. The male connector includes paired guide ribs provided on an outer periphery of the male connector. The paired guide ribs either positioned in the paired guide grooves with the female connector and the male connector being fitted together are configured to regulate a relative rotational movement between the female connector and the male connector. The regulation projections either in contact with the paired guide ribs are configured to regulate a relative vertical and transverse movement between the female connector and the male connector.

According to the configuration above, the guide ribs are inserted into the guide grooves. It is therefore possible to restrict a relative rotational movement between the female connector and the male connector.

The guide grooves have on the bottom surfaces the regulation projections either in contact with the guide ribs to regulate a relative vertical and transverse movement between the female connector and the male connector. It is therefore possible to inhibit an increase in a fitting force of the female connector and the male connector.

Therefore, it is possible to provide a connector capable of restricting a relative rotational movement between a female connector and a male connector and inhibiting an increase in a fitting force of the female connector and the male connector.

The female connector may include: a female connector housing; a connector main body having a terminal receiver; and an outer hood covering the connector main body. The paired guide grooves may be provided on an inside wall of the outer hood. The regulation projections may be either provided at rear positions of guide surfaces of the paired guide grooves.

According to the above-described configuration, the regulation projections are provided at the rear positions of the guide surfaces of the paired guide grooves provided on the inside wall of the outer hood. It is therefore possible to, when the female connector and the male connector are fitted together, restrict a relative rotational movement between the female connector and the male connector and to reduce a friction between the female terminal and the male tab caused by a rotational movement of the connector.

The female connector and the male connector have a proper amount of clearance (clearance gap) therebetween when the female connector and the male connector are fitted together. It is therefore possible to inhibit an increase in a fitting force of the connector.

The male connector may include: a male connector housing; and a fitting hood inserted into between the connector main body and the outer hood when the female connector and the male connector are fitted together. The paired guide ribs may be either formed on side walls of the fitting hood located in a direction of a longer of a length of the fitting hood in a vertical direction or a length of the fitting hood in a transverse direction of the fitting hood.

According to the above-described configuration, the paired guide ribs are formed on the both side walls of the fitting hood. It is therefore possible to hold the female connector and the male connector in the regular fitting position. The guide ribs are also inserted into the guide grooves. It is therefore possible to increase a holding force.

The paired guide ribs are either formed on side walls of the fitting hood located in a direction (the transverse direction in an embodiment of the present invention) of a longer of a length of the fitting hood in a vertical direction or a length of the fitting hood in a transverse direction of the fitting hood. It is therefore possible to restrict a relative rotational movement between the female connector and the male connector.

BRIEF DESCRIPTION OF DRAWINGS

FIGS. 1A to 3C are plan views illustrating a related connector.

FIG. 2 is a perspective view illustrating a female connector and a male connector according to an embodiment of the present invention.

FIG. 3 is a perspective view illustrating a connector according to the embodiment of the present invention.

DETAILED DESCRIPTION

Figure 1C:
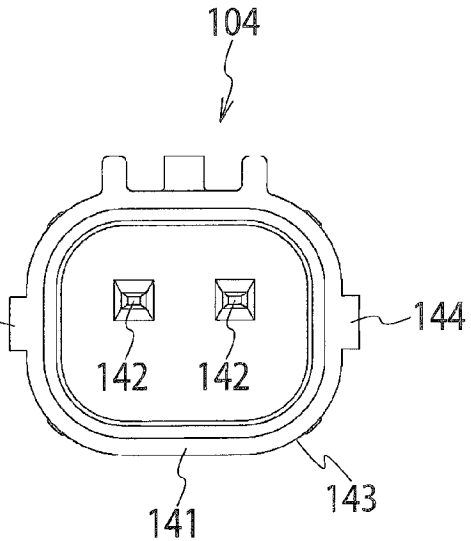
Figure 1B:
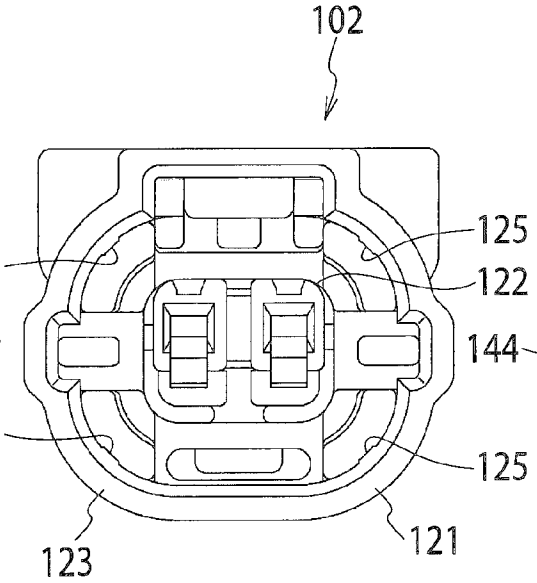
Prior Art FIG. 1B
Figure 1A:
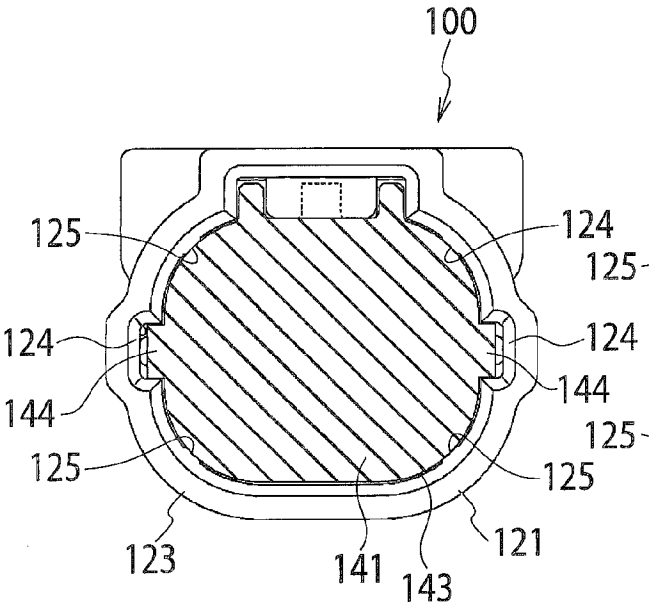
Prior Art FIG. 1A
Figure 2:
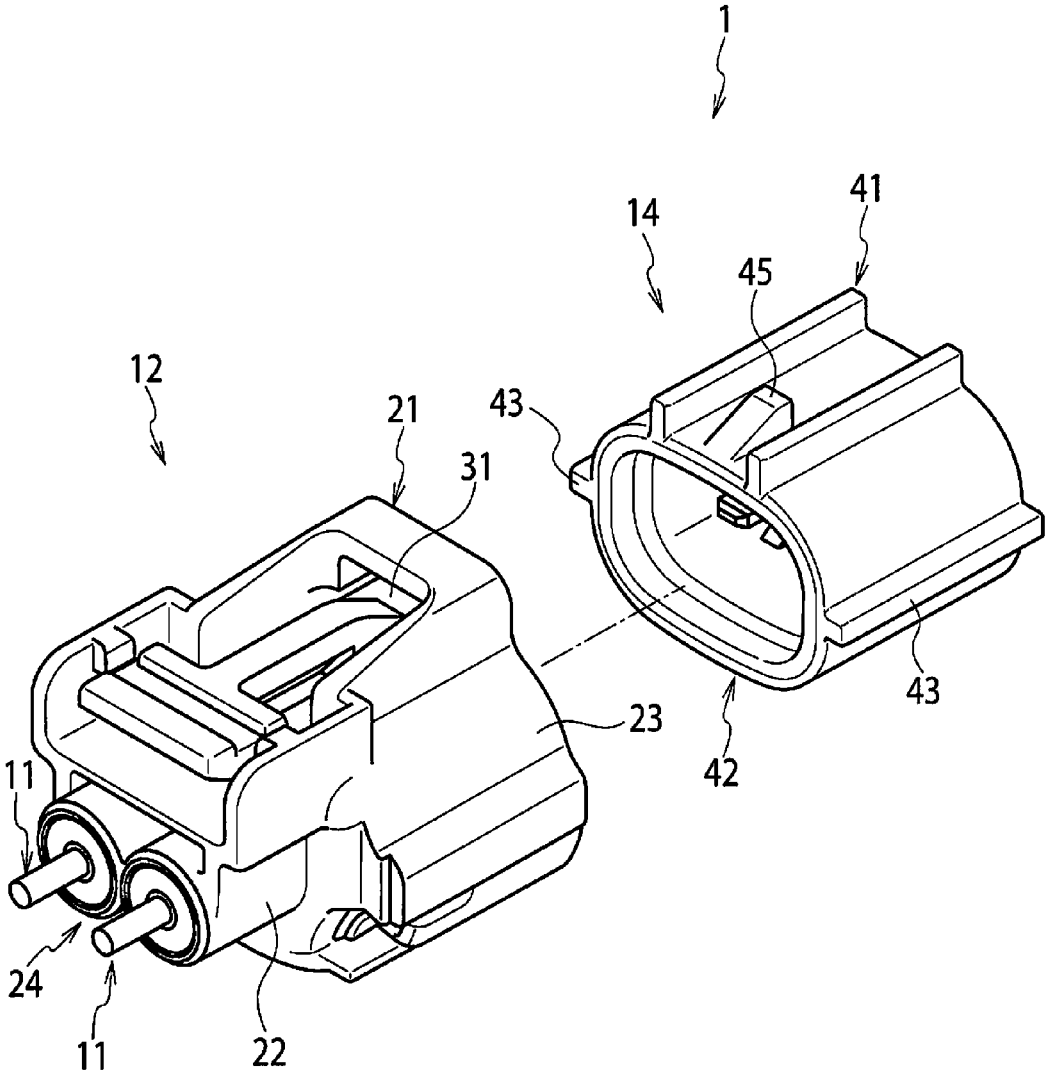
Figure 3:
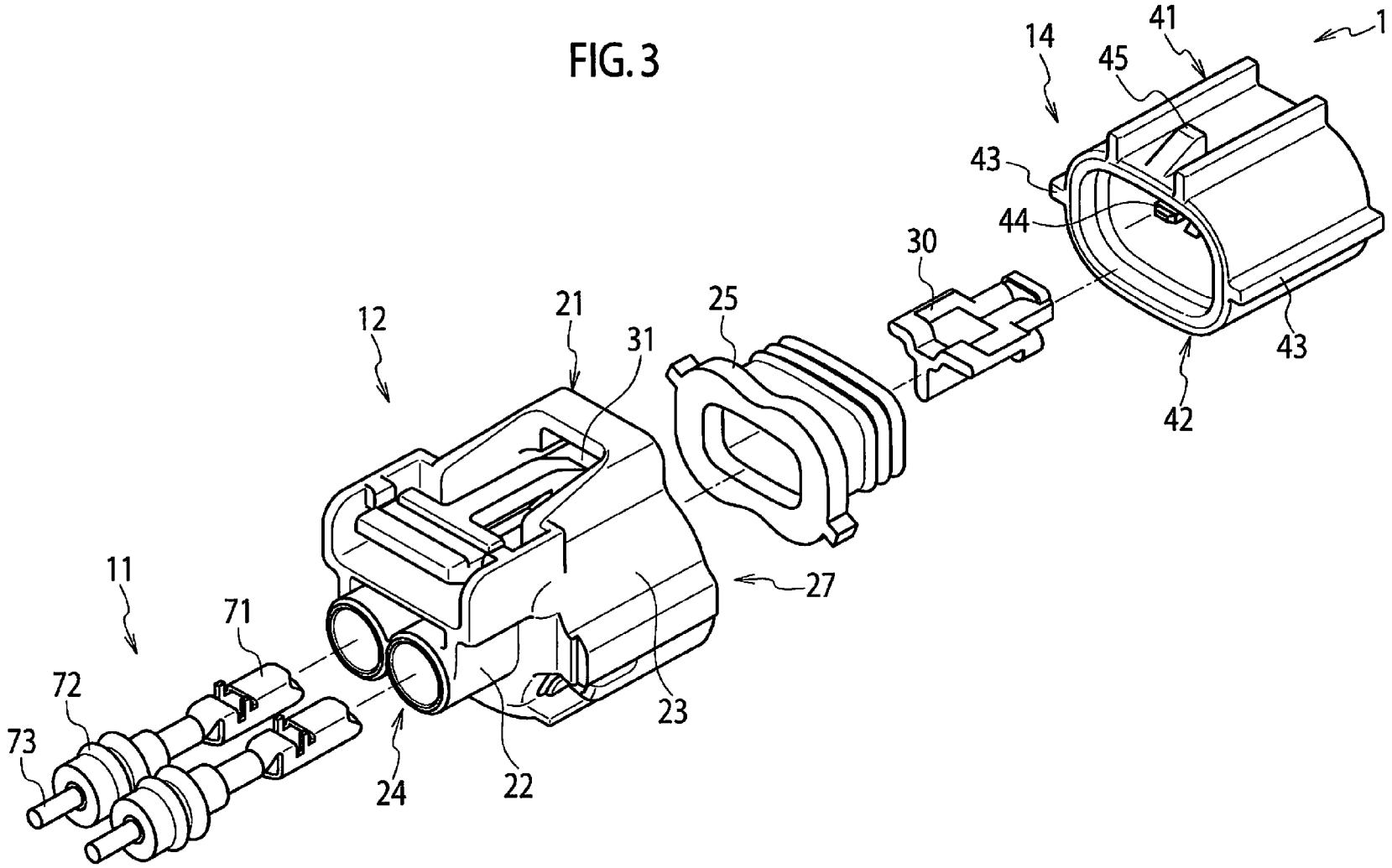

A connector 1 according to an embodiment of the present invention will be described below with reference to the accompanying drawings. First, the connector 1 according to the embodiment of the present invention will be described with reference to FIGS. 2 and 3. FIG. 2 is a perspective view illustrating a female connector 12 and a male connector 14 according to the embodiment of the present invention. FIG. 3 is a perspective view illustrating the connector 1 according to the embodiment of the present invention.

The connector 1 according to the embodiment of the present invention is a connector for electrically connecting female terminals 11 and male terminals of electric wire terminals (terminals used for a vehicle or for wiring of electrical equipment and the like installed on a vehicle).

As illustrated in FIGS. 2 and 3, the connector 1 includes the female connector 12 which accommodates the female terminals 11 therein, and the male connector 14 which is fitted with the female connector 12 for connecting the male terminals (not illustrated) with the female terminals 11.

The female connector 12 includes a female connector housing 21 which is cylindrically formed of synthetic resin material and the like, a connector main body 22 which accommodates the female terminals 11 therein, and an outer hood 23 which covers the connector main body 22.

The connector main body 22 includes terminal receivers 24 with the cylindrical inside in which the female terminals 11 are accommodated; and a waterproof plug receiver 26 accommodating a waterproof plug 25 (a packing; see FIG. 3) which is flexurally deformed to the inward side of the connector main body 22 when the male connector 14 is being fitted with the female connector 12.

The waterproof plug 25 is formed approximately in a ring shape with a through hole in the middle. When the male connector 14 and the female connector 12 are fitted together with the waterproof plug 25 accommodated in the waterproof plug receiver 26, the waterproof plug 25 is elastically expanded to come in close contact with the inside walls of the male connector 14 and the female connector 12. This prevents ingress of water into the connector 1 from the side of the male connector 14.

Figure 5B:
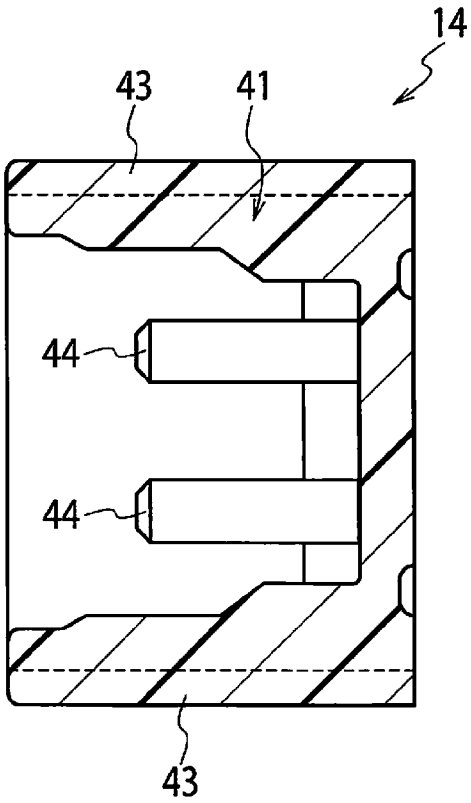
FIGS. 5A and 5B are cross-sectional views illustrating the female connector and the male connector according to the embodiment of the present invention.

As to be described below with reference to FIGS. 5A and 5B, the outer hood 23 has paired guide grooves 27 either at opposed positions on the inside wall thereof.

The guide grooves 27 have guide ribs 43 provided on the outer periphery of the male connector 14 below inserted thereinto to hold the female connector 12 and the male connector 14 in a regular fitting position, restricting a relative rotational movement between the female connector 12 and the male connector 14.

As to be described below with reference to FIGS. 5A and 5B, the paired guide grooves 27 have regulation projections 29 either on the bottom surfaces thereof. These regulation projections 29 come in contact with the guide ribs 43 of the male connector 14 below to regulate a relative vertical and transverse movement of the female connector 12 and the male connector 14 to a fitting direction in which the female connector 12 and the male connector 14 are moved for fitting together.

Specifically, if the regulation projections 29 are not provided on the paired guide grooves 27, there is a certain amount of clearance (clearance gap) between the female connector 12 and the male connector 14.

Figure 4B:
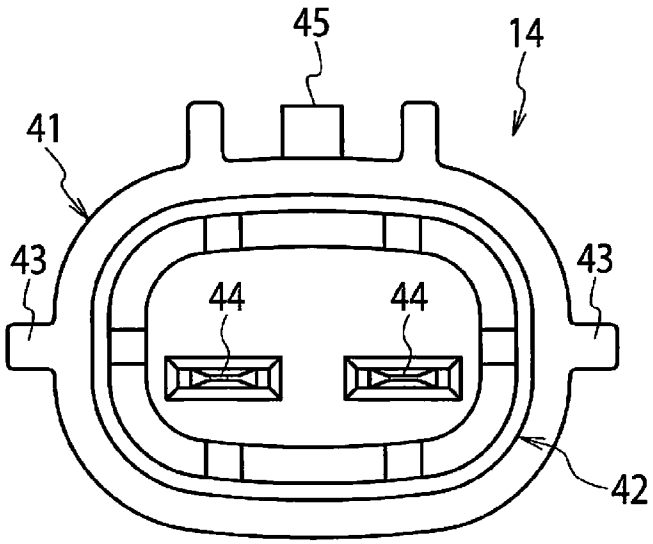
FIGS. 4A and 4B are plan views illustrating the inside of the connector according to the embodiment of the present invention.
Figure 4A:
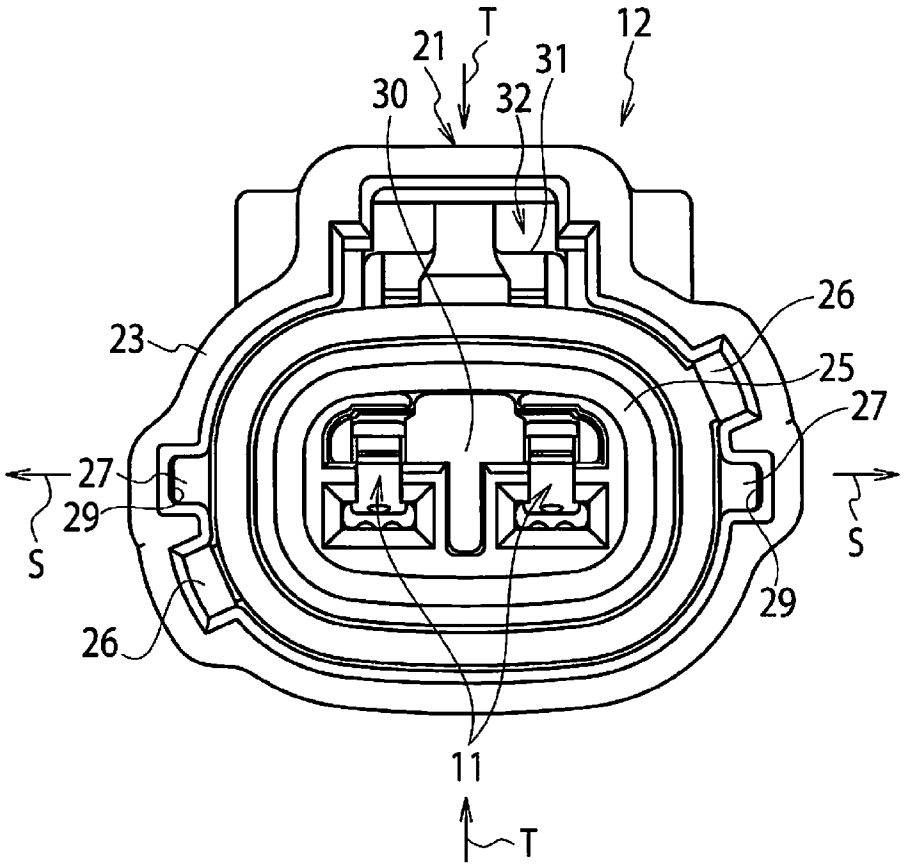

According to the embodiment of the present invention, the connector 1 is provided with the regulation projections 29 which come in contact with the guide ribs 43 to permit the female connector 12 to be deformed within a range of the transverse direction of the female connector 12 in the direction indicated by the arrows S in FIG. 4A bellow.

This deformation in the transverse direction permits the female connector 12 to be deformed within a range of the vertical direction of the female connector 12 in the direction indicated by the arrows T in FIG. 4A bellow, reducing an amount of clearance (clearance gap) between the female connector 12 and the male connector 14.

For the transverse direction of the female connector 12, the regulation projections 29 in contact with the guide ribs 43 restrict the relative rotational movement between the female connector 12 and the male connector 14. For the vertical direction of the female connector 12, the regulation projections 29 in contact with the guide ribs 43 reduce the amount of clearance (clearance gap) between the female connector 12 and the male connector 14, restricting the relative rotational movement between the female connector 12 and the male connector 14.

Such being the case, the guide ribs 43 inserted into the guide grooves 27 enable to restrict the relative rotational movement between the female connector 12 and the male connector 14.

The guide grooves 27 have on the bottom surface the regulation projections 29 which come in contact with the guide ribs 43 to regulate the relative vertical and transverse movement between the female connector 12 and the male connector 14. It is therefore possible to inhibit an increase in a fitting force with which the female connector 12 and the male connector 14 are fitted together.

Accordingly, it is possible to provide the connector 1 which is capable of restricting the relative rotational movement between the female connector 12 and the male connector 14 and inhibiting an increase in the fitting force of the female connector 12 and the male connector 14.

The female connector 12 includes a front holder 30 which comes in contact with the inside wall of the waterproof plug 25 (inside the ring) to be fitted with male tabs 44 of the male connector 14 bellow.

The male connector 14 includes a male connector housing 41 which is formed in a cylindrical shape of synthetic resin material and the like, and a fitting hood 42 which is inserted in between the connector main body 22 and the outer hood 23 when the female connector 12 and the male connector 14 are fitted together.

The fitting hood 42 is formed in a cylindrical shape with a transversely elongated cross-section. The fitting hood 42 includes the guide ribs 43 which are either integrally formed on the both side walls of the fitting hood 42 and extend in the front-back direction (in the fitting direction of the female connector 12 and the male connector 14). The male connector 14 also includes the male tabs 44 (see FIG. 3) which are fitted with the front holder 30 of the female connector 12.

The guide ribs 43 which are either integrally formed on the both side walls of the fitting hood 42 are accommodated in the guide grooves 27 provided in the female connector 12 when the female connector 12 and the male connector 14 are fitted together.

The guide ribs 43 are formed on the both side walls of the fitting hood 42 located in a direction (the transverse direction for the embodiment of the present invention) of a longer one of the length of the fitting hood 42 in the vertical direction or the length of the fitting hood 42 in the transverse direction. In other words, the guide ribs 43 are formed on the transverse side walls of the fitting hood 42 in the embodiment of the present invention.

Such being the case, the guide ribs 43 formed on the both side walls of the fitting hood 42 enable the female connector 12 and the male connector 14 to be held in the regular fitting position. The guide ribs 43 inserted into the guide grooves 27 (see FIG. 5A bellow) enable to increase a holding force.

The guide ribs 43 formed on the both side walls of the fitting hood 42 located in a direction (the transverse direction for the embodiment of the present invention) of a longer one of the length of the fitting hood 42 in the vertical direction or the length of the fitting hood 42 in the vertical direction enable to restrict the relative rotational movement between the female connector 12 and the male connector 14.

As illustrated in FIG. 3, the female terminals 11 include connections 71 connected with ends (not illustrated) of the male terminals, terminal waterproof plugs (packing) 72 which come in close contact with the terminal receivers 24 of the female connector 12, and electric wires 73 connected to a vehicle or electrical equipment and the like installed on a vehicle.

The terminal waterproof plugs 72 are elastically expanded to come in close contact with inside walls of the terminal receivers 24 of the female connector 12. This prevents ingress of water into the connector 1 via the terminal receivers 24.

Next, fitting of the female connector 12 and the male connector 14 will be described with reference to FIGS. 4A to 6.

FIG. 4A is a plan view illustrating the inside of the female connector 12 according to the embodiment of the present invention. FIG. 4B is a plan view illustrating the inside of the male connector 14 according to the embodiment of the present invention. FIG. 5A is a cross-sectional view illustrating the female connector 12 according to the embodiment of the present invention. FIG. 5B is a cross-sectional view illustrating the male connector 14 according to the embodiment of the present invention. FIG. 6 is a cross-sectional view illustrating the connector 1 according to the embodiment of the present invention.

As illustrated in FIGS. 4A to 6, when the female connector housing 21 and the male connector housing 41 are fitted together, the fitting hood 42 is inserted into between the connector main body 22 and the outer hood 23. When fitting, the guide ribs 43 slide on the guide grooves 27 to guide the male connector 14 to the regular fitting position.

In this state, the female terminals 11 are accommodated in the terminal receivers 24 of the connector main body 22. When the female connector housing 21 and the male connector housing 41 are fitted together, the connections 71 of the female terminals 11 are connected with connections (not illustrated) of the male terminal and the waterproof plug 25 is accommodated in the waterproof plug receiver 26 of the connector main body 22 (see FIG. 3).

The male tabs 44 provided inside the male connector housing 41 are fitted with one side of the front holder 30 (a side opposed to the waterproof plug 25) approximately at the center in the fitting direction of the female connector 12 and the male connector 14 (see FIG. 3).

And then, a lock arm 31 provided in the female connector housing 21 runs on the upper portion of a lock projection 45 provided in the male connector housing 41 to be flexurally deformed in the upper direction.

When the female connector 12 and the male connector 14 are fitted together to the regular fitting position, the lock projection 45 is inserted inside a lock hole 32 (see FIG. 4A) and the lock arm 31 goes back to the original shape from the flexural deformation.

Such being the case, an end portion of the lock projection 45 on the side of the male connector 14 is in contact with and engaged with a portion of the lock arm 31 on the side of the female terminals 11. It is therefore possible to hold the female connector 12 and the male connector 14 such that the female connector 12 and the male connector 14 cannot be detached from each other from a fitting state where the female connector 12 and the male connector 14 are fitted together.

Figure 5A:
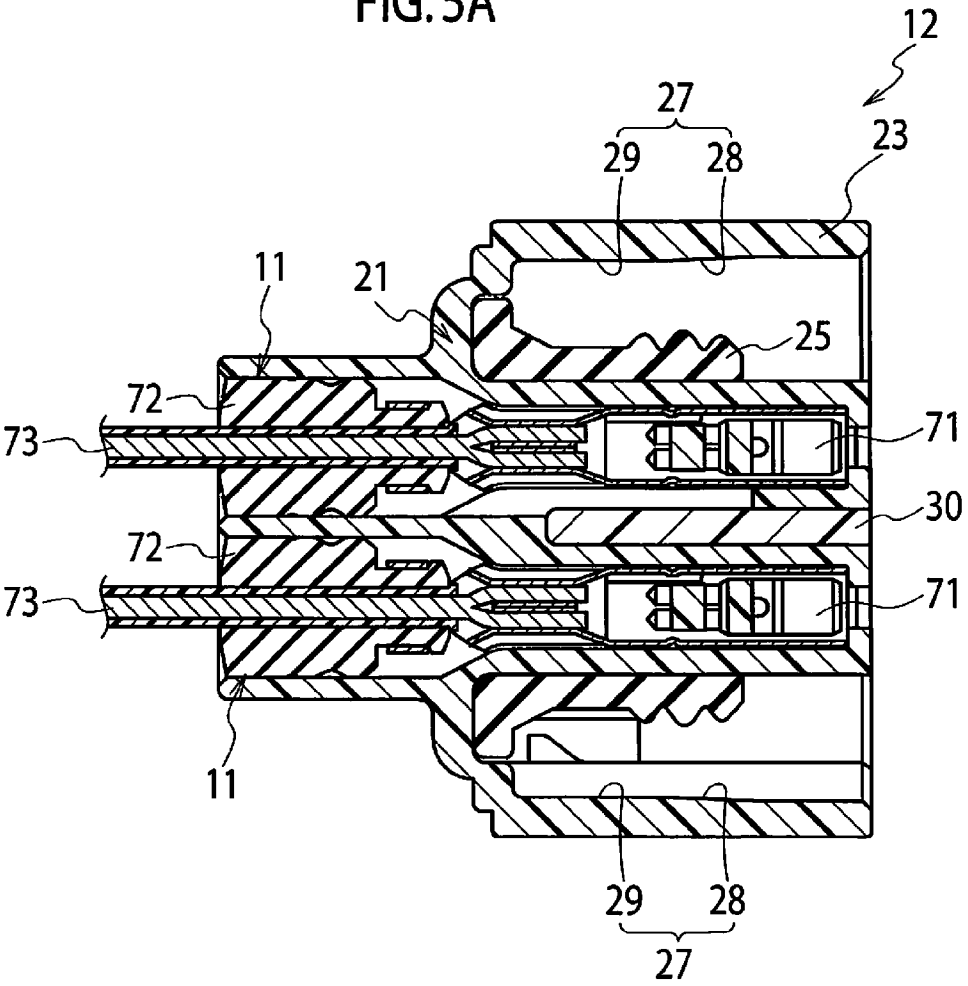
Figure 6:
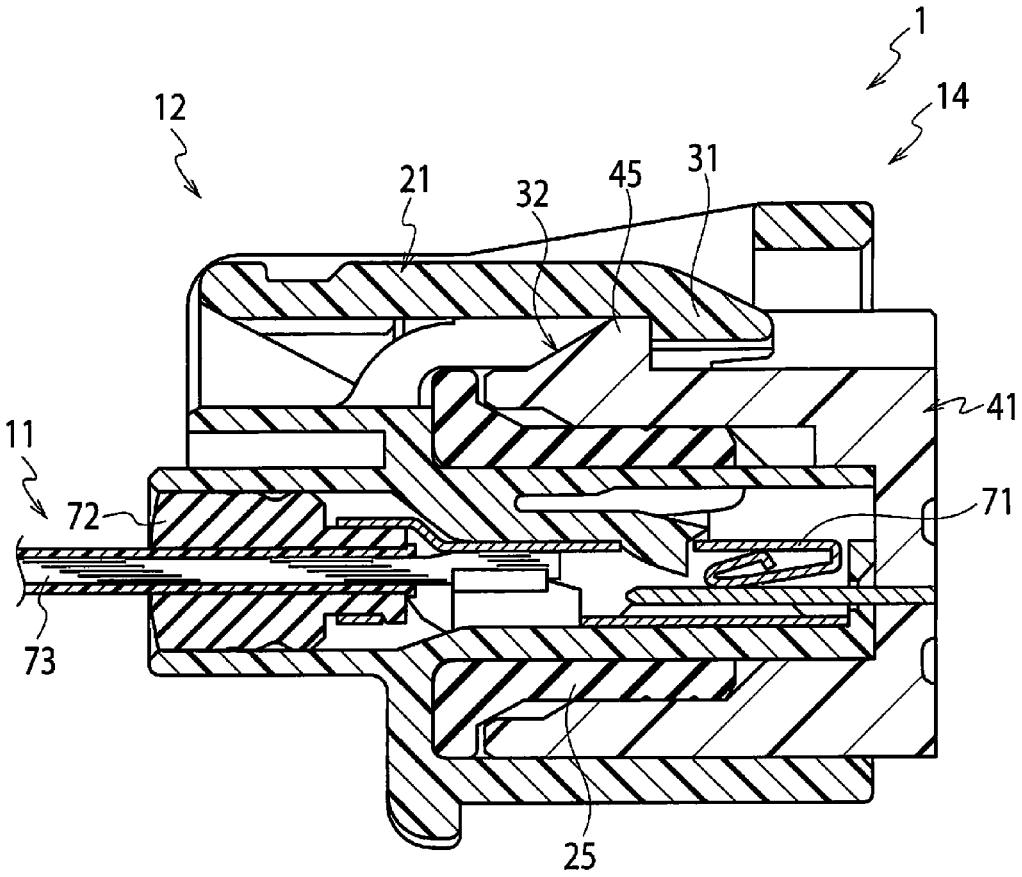
FIG. 6 is a cross-sectional view illustrating the connector according to the embodiment of the present invention.

As illustrated in FIG. 5A, the female connector 12 according to the embodiment of the present invention has the regulation projections 29 provided at the rear positions of guide surfaces 28 of the first and second guide grooves 27 provided on the inside wall of the outer hood 23.

The regulation projections 29 are provided at positions adjacent to the terminal receivers 24 where regulation projections 29 can reduce a friction between the female terminals 11 and the male tabs 44 generated by a rotation of the connector 1.

Such being the case, the regulation projections 29 are provided at the rear positions of the guide surfaces 28 of the paired guide grooves 27 provided on the inside wall of the outer hood 23. It is therefore possible to restrict the relative rotational movement between the female connector 12 and the male connector 14 and reduce a friction between the female terminals 11 and the male tabs 44 generated by a rotational movement of the connector 1 when the female connector 12 and the male connector 14 are fitted together.

The female connector 12 and the male connector 14 can have a proper amount of clearance (clearance gap) therebetween when the female connector 12 and the male connector 14 are fitted together. It is therefore possible to inhibit an increase in the fitting force of the connector 1.

Next, the regulation projections 29 provided in the female connector 12 according to the embodiment of the present invention will be described in detail with reference to FIGS. 7 to 9C.

Figure 7:
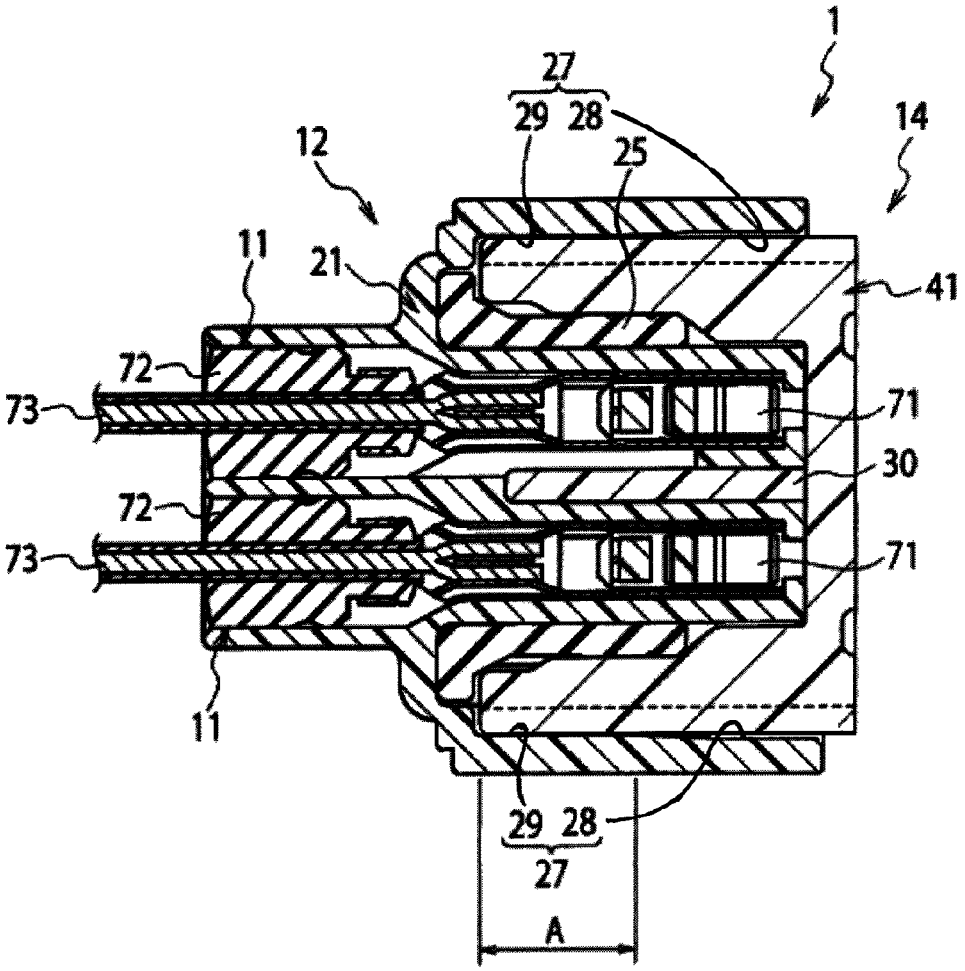
FIG. 7 is a cross-sectional view illustrating the female connector according to the embodiment of the present invention.
Figure 8B:
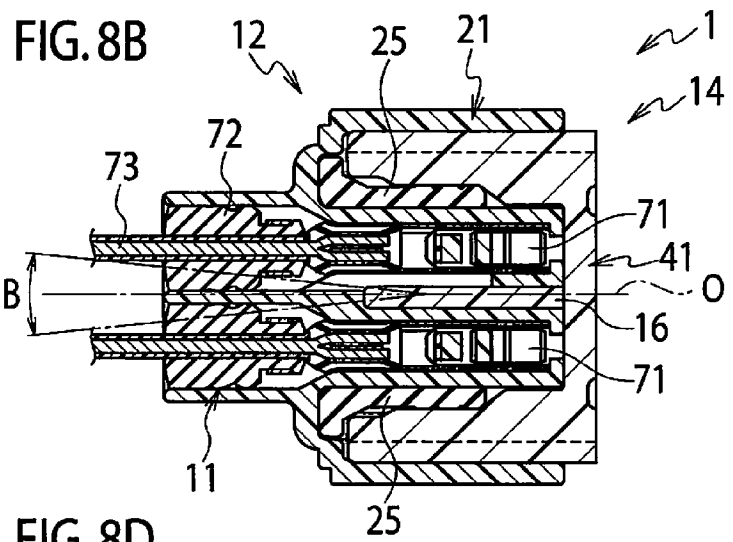
FIGS. 8B to 8D are cross-sectional views for explaining a rotational movement of the connector.
Figure 8A:
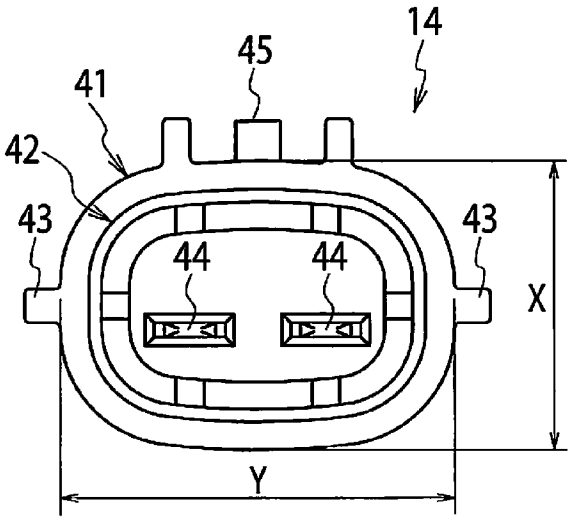
FIG. 8A is an elevation view illustrating the connector according to the embodiment of the present invention.
Figure 8D:
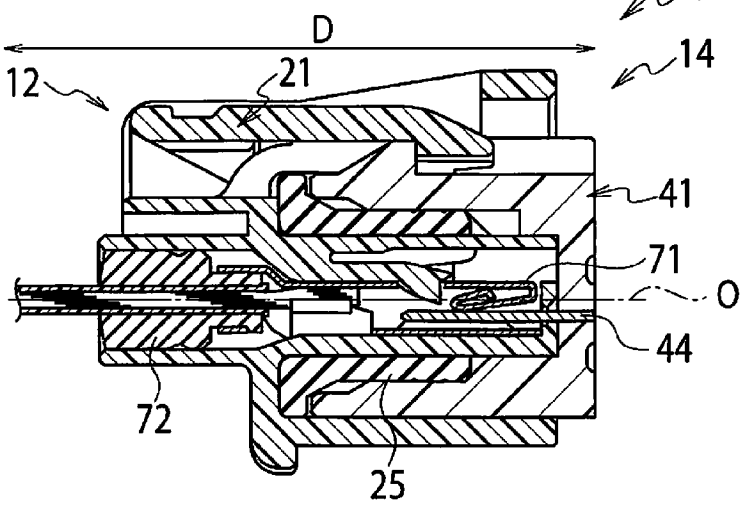
Figure 8C:
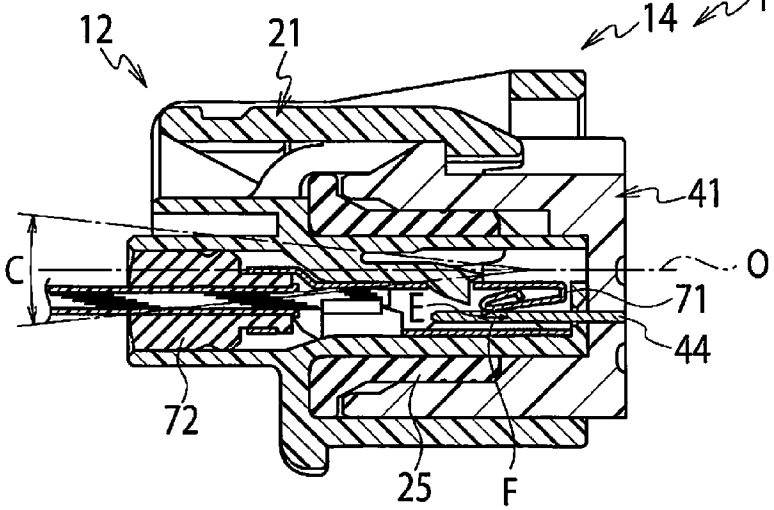

FIG. 7 is a cross-sectional view illustrating the female connector 12 according to the embodiment of the present invention. FIG. 8A is an elevation view illustrating the male connector 14 according to the embodiment of the present invention. FIG. 8B is a cross-sectional view for explaining a movement in the transverse direction of the female connector 12 according to the embodiment of the present invention. FIG. 8C is a cross-sectional view for explaining a movement in the vertical direction of the female connector 12 according to the embodiment of the present invention. FIG. 8D is a cross-sectional view for explaining a movement in a front-back direction of the female connector 12 according to the embodiment of the present invention.

Figures 9A, 9B, 9C:
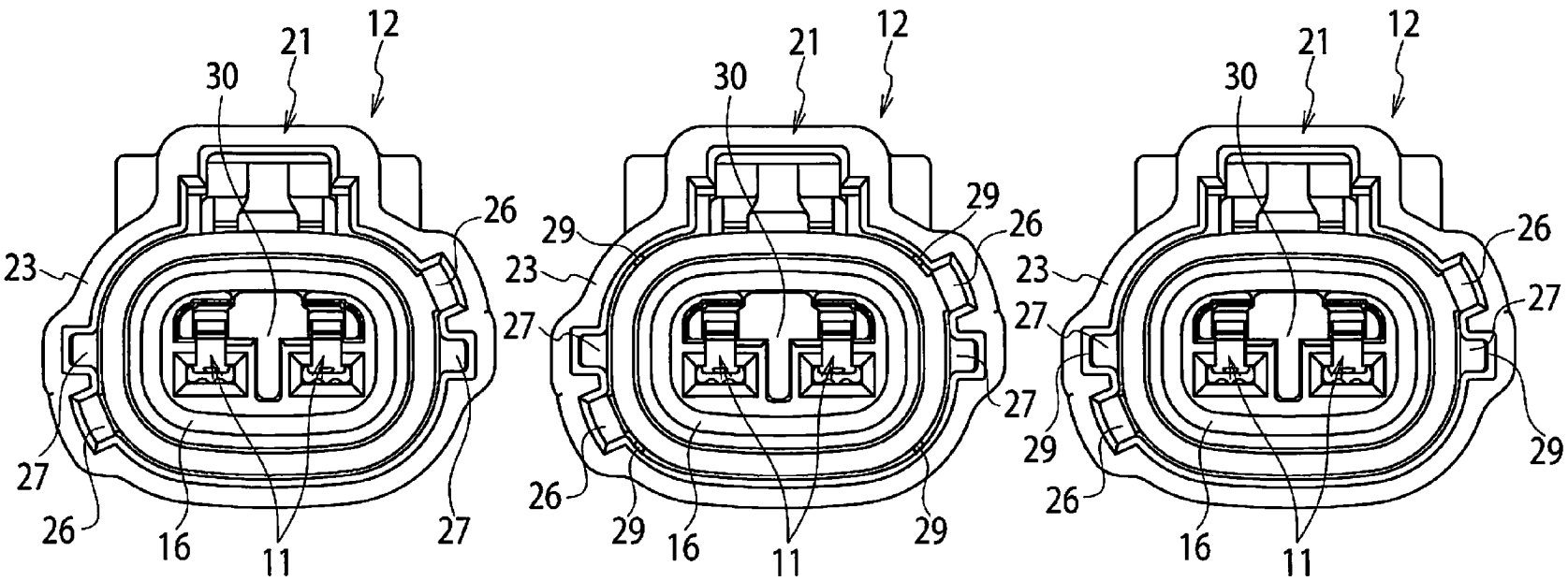
FIG. 9A is a plan view for explaining a configuration of regulation projections according to the embodiment of the present invention by comparison.
FIG. 9B is a plan view for explaining contact between the female and male connectors according to the embodiment of the present invention by comparison.
FIG. 9C is a plan view for explaining the regulation projections of the connector according to the embodiment of the present invention.

FIG. 9A is a comparison plan view for explaining a configuration of the regulation projections 29 according to the embodiment of the present invention. FIG. 9B is a comparison view for explaining contact between the female connector 12 and the male connector 14 according to the embodiment of the present invention. FIG. 9C is a view for explaining the regulation projections 29 of the connector according to the embodiment of the present invention.

As illustrated in FIG. 7, the female connector 12 is provided with the paired guide grooves 27 each having the guide surface 28 and the regulation projection 29 within the width A set to the outer hood 23 on the side of the terminal receivers 24. The regulation projections 29 are either provided at the rear positions of the guide surfaces 28 of the paired guide grooves 27.

As illustrated in FIG. 8A, the guide ribs 43 are either formed on the both side walls (the both side walls located in the transverse direction in FIG. 8A) of the fitting hood 42 located in a direction of a longer one of the length X of the fitting hood 42 in the vertical direction or the length Y of the fitting hood 42 in the transverse direction.

When the female connector 12 is moved in the transverse direction B (in the direction horizontal to the fitting direction of the female connector 12 and the male connector 14) as illustrated in FIG. 8B and the female connector 12 is moved in the vertical direction C (in the direction perpendicular to the fitting direction of the female connector 12 and the male connector 14) as illustrated in FIG. 8C, the contact points E of the female terminals 11 and the male tabs 44 are moved in the transverse direction and for the front-back direction.

When the female connector 12 is moved in the front-back direction D (in the fitting direction of the female connector 12 and the male connector 14) as illustrated in FIG. 8D, the contact points E of the female terminals 11 and the male tabs 44 are moved in the front-back direction.

If the distance between the center line O of the female connector 12 and the male connector 14 illustrated in FIGS. 8B to 8D and the contact points E of the female terminals 11 and the male tabs 44 is larger, the movement distance F of the contact points E of the female terminals 11 and the male tabs 44 (see FIG. 8C) is also larger and abrasion at the contact points E is promoted by the movement (rotational movement) of the connector 1, decreasing the vibration proof of the connector 1.

According to the embodiment of the present invention, the connector 1 has the regulation projections 29 provided at the rear positions of the guide surfaces 28 of the paired guide grooves 27 of the female connector 12 (the side of the terminal receivers 24) and adjacent to a position where the movement distance F (see FIG. 8C) is large.

If the outer hood 23 does not have the regulation projections 29 as illustrated in FIG. 9A, there is not a proper amount of clearance (clearance gap) between the fitting hood 42 and the regulation projections 29, causing a problem of an increase in the fitting force.

Particularly the fitting hood 42 of the male connector 14 is formed in a thin cylindrical shape of synthetic resin material and the like. This causes warpage at the time of formation of resin and the warpage interferes with the female connector 12 when the male connector 14 is fitted with the female connector 12, increasing a fitting resistance between the male connector 14 and the female connector 12.

In contrast, if the regulation projections 29 are provided at four locations in the direction perpendicular to the fitting direction of the female connector 12 and the male connector 14 as illustrated in FIG. 9B, the male connector 14 is elastically expanded when the male connector 14 is fitted with the female connector 12. For this reason, the male connector 14 comes in contact with the female connector 12 also at portions other than the regulation projections 29.

If the regulation projections 29 are provided at two locations in the direction perpendicular to the fitting direction of the female connector 12 and the male connector 14 as illustrated in FIG. 9C, both an amount of clearance (clearance gap) at the portions other than the regulation projections 29 and the fitting force are decreased.

For this reason, according to the embodiment of the present invention, the connector 1 has the paired guide grooves 27 provided on the inside wall of the outer hood 23 of the female connector 12 and the regulation projections 29 provided at the rear positions of the guide surfaces 28 of the paired guide grooves 27 (see FIGS. 5A and 7) in order to restrict the rotational movement of the connector 1 in the direction in which the movement distance F of the contact points E of the female terminals 11 and the male tabs 44 is increased.

Such being the case, the regulation projections 29 are provided at the rear positions of the guide surfaces 28 of the paired guide grooves 27. It is therefore possible to reduce the friction at each of the contact points E generated by the movement (rotational movement) of the connector 1 and restrict the rotational movement of the connector 1, inhibiting an increase in the fitting force.

According to the embodiment of the present invention, the connector 1 has the female connector 12 which accommodates the female terminals 11 of an electric wire terminal and has the hood (the outer hood) 23, and the male connector 12 which accommodates the male terminals of an electric wire terminal and is fitted in the hood 23 of the female connector 12 for connection of the female terminals 11 and the male terminals. The connector 1 includes the paired guide grooves 27 either provided at the opposed positions on the inside wall of the hood 23 of the female connector 12, the paired guide ribs 43 provided on the outer periphery of the male connector 14 and either inserted into the paired guide grooves 27 with the female connector 12 and the male connector 14 being fitted together to regulate the relative rotational movement between the female connector 12 and the male connector 14, and the regulation projections 29 either provided on the bottom surfaces of the paired guide grooves 27 and either in contact with the paired guide ribs 43 to regulate the relative vertical and transverse movement between the female connector 12 and the male connector 14.

According to the embodiment of the present invention, the connector 1 has the female connector 12 including the female connector housing 21, the connector main body 22 having the terminal receivers 24, and the outer hood 23 covering the connector main body 22. The paired guide grooves 27 are provided on the inside wall of the outer hood 23. The regulation projections 29 are either provided at the rear positions of the guide surfaces of the paired guide grooves 27.

According to the embodiment of the present invention, the connector 1 has the male connector 14 including the male connector housing 41 and the fitting hood 42 inserted into between the connector main body 22 and the outer hood 23 when the female connector 12 and the male connector together 14 are fitted together. The guide ribs 43 are formed on the both side walls of the fitting hood 42 located in a direction of a longer one of the length of the fitting hood 42 in the vertical direction or the length of the fitting hood 42 in the transverse direction.

According to the embodiment of the present invention, the connector 1 has the guide ribs 43 inserted into the guide grooves 27. It is therefore possible to restrict the relative rotational movement between the female connector 12 and the male connector 14.

The guide grooves 27 have at the bottom surfaces the regulation projections 29 which come in contact with the guide ribs 43 to restrict the relative vertical and transverse movement between the female connector 12 and the male connector 14. It is therefore possible to inhibit an increase in the fitting force.

It is therefore possible to provide the connector 1 capable of restricting the relative rotational movement between the female connector 12 and the male connector 14 and inhibit an increase in the fitting force of the female connector 12 and the male connector 14.

According to the embodiment of the present invention, the connector 1 has the regulation projections 29 provided at the rear positions of the guide surfaces 28 of the paired guide grooves 27 provided on the inside wall of the outer hood 23. It is therefore possible to restrict the relative rotational movement between the female connector 12 and the male connector 14 and reduce the friction between the female terminals 11 and the male tabs 44 generated by a rotational movement of the connector 1 when the female connector 12 and the male connector together 14 are fitted together.

The female connector 12 and the male connector 14 have a proper amount of clearance (clearance gap) therebetween when the female connector 12 and the male connector 14 are fitted together. It is therefore possible to inhibit an increase in the fitting force of the connector 1.

According to the embodiment of the present invention, the connector 1 has the paired guide ribs 43 formed on the both side walls of the fitting hood 42. It is therefore possible to hold the female connector 12 and the male connector 14 in the regular fitting position. The connector 1 also has the guide ribs 43 inserted into the guide grooves 27. It is therefore possible to increase the holding force.

The guide ribs 43 are formed on the both side walls of the fitting hood 42 located in a direction (the transverse direction for the embodiment of the present invention) of a longer one of the length of the fitting hood 42 in the vertical direction or the length of the fitting hood 42 in the transverse direction. It is therefore possible to restrict the relative rotational movement between the female connector 12 and the male connector 14.

According to the embodiment of the present invention, the connector 1 has the regulation projections 29 provided at the rear positions of the guide surfaces 28 of the paired guide grooves 27. It is therefore possible to reduce the friction at each of the contact points E (see FIG. 8C) generated by the rotational movement of the connector 1 and restrict the rotational movement of the connector 1, inhibiting an increase in the fitting force.

The connector 1 has been described above based on the illustrated embodiment. However, it is to be understood that the present invention will not be limited only to the embodiment and that the configurations of the respective constituents may be replaced by any other arbitrary configurations having similar functions.

In the embodiment of the present invention above, for example, the guide ribs 43 are formed to be located in the transverse direction of the fitting hood 42. However, the guide ribs 43 may be formed to be located in the vertical direction of the fitting hood 42 when, among the lengths in the vertical direction and the transverse direction of the fitting hood 42, the length in the vertical direction is greater than the length in the transverse direction.

What is claimed is:

1. A connector comprising:

a female connector configured to accommodate a female terminal of an electric wire terminal and having a hood; and a male connector configured to accommodate a male terminal of an electric wire terminal and be fitted in the hood for connection of the female terminal and the male terminal, wherein the female connector includes first and second guide grooves respectively provided on an inside wall of the hood in opposed positions in a transverse direction, a first regulation projection provided on a first bottom surface of the first guide groove, and a second regulation projection provided on a second bottom surface of the second guide groove;

the first bottom surface and the second bottom surface face each other in the transverse direction;

the male connector includes first and second guide ribs provided on an outer periphery of the male connector;

the first and second guide ribs are positioned in the first and second guide grooves with the female connector and the male connector being fitted together, wherein the first and second guide ribs are configured to regulate a relative rotational movement between the female connector and the male connector;

the first and second regulation projections respectively being in contact with the first and second side surfaces of the first and second guide ribs in the transverse direction are configured to regulate a relative vertical and transverse movement between the female connector and the male connector, the regulation projections provided only at a distal end of the first and second guide grooves adjacent to the female terminal housed within the female connector; and the female connector is configured to be extended in the transverse direction and shrunk in a vertical direction by the first and second regulation projections and the first and second guide ribs being in contact with each other.

2. The connector according to claim 1, wherein:

the female connector includes a female connector housing for connecting with the male connector, a connector main body having a terminal receiver, the connector main body in contact with and surrounded by the female connector housing, and the hood covering the connector main body;

the first and second guide grooves are provided on an inside wall of the hood; and the regulation projections are provided at rear positions of guide surfaces of the first and second guide grooves.

3. The connector according to claim 2, wherein:

the male connector includes a male connector housing, and a fitting hood formed at one end of the male connector housing and inserted into between the connector main body and the hood when the female connector and the male connector are fitted together, and the first and second guide ribs are formed on side walls of the fitting hood located in a direction of a longer of a length of the fitting hood in a vertical direction or a length of the fitting hood in a transverse direction of the fitting hood.

4. The connector according to claim 1, wherein the bottom surfaces of the first and second guide grooves face each other in the transverse direction, and wherein the regulation projections are configured to be in contact with side surfaces of the first and second guide ribs in the transverse direction.

5. The connector according to claim 2, wherein the bottom surfaces of the first and second guide grooves face each other in the transverse direction, and wherein the regulation projections are configured to be in contact with side surfaces of the first and second guide ribs in the transverse direction.

6. The connector according to claim 3, wherein the bottom surfaces of the first and second guide grooves face each other in the transverse direction, and wherein the regulation projections are configured to be in contact with side surfaces of the first and second guide ribs in the transverse direction.

* * * * *